US009350123B2

(12) United States Patent
Siebens

(10) Patent No.: US 9,350,123 B2
(45) Date of Patent: May 24, 2016

(54) ELBOW WITH INTERNAL ASSEMBLY SYSTEM

(71) Applicant: Thomas & Betts International, LLC, Wilmington, DE (US)

(72) Inventor: Larry Norman Siebens, Ashbury, NJ (US)

(73) Assignee: Thomas & Betts International LLC, Wilmington, DE (US)

( * ) Notice: Subject to any disclaimer, the term of this patent is extended or adjusted under 35 U.S.C. 154(b) by 0 days.

(21) Appl. No.: 14/750,172

(22) Filed: Jun. 25, 2015

(65) Prior Publication Data

US 2015/0380880 A1 Dec. 31, 2015

Related U.S. Application Data

(60) Provisional application No. 62/017,531, filed on Jun. 26, 2014.

(51) Int. Cl.

| | |
|---|---|
| ***H01R 13/53*** | (2006.01) |
| ***H01R 13/73*** | (2006.01) |
| ***H01R 4/36*** | (2006.01) |
| ***H01R 4/58*** | (2006.01) |
| ***H01R 9/18*** | (2006.01) |
| *H01R 11/12* | (2006.01) |

(52) U.S. Cl.

CPC ..... *H01R 13/73* (2013.01); *H01R 4/36* (2013.01); *H01R 4/58* (2013.01); *H01R 9/18* (2013.01); *H01R 13/53* (2013.01); *H01R 11/12* (2013.01)

(58) Field of Classification Search

CPC ..... H01R 13/53; H01R 13/6485

See application file for complete search history.

(56) References Cited

U.S. PATENT DOCUMENTS

| | | | | |
|---|---|---|---|---|
| 3,959,869 | A | 6/1976 | Wyman et al. | |
| 4,202,591 | A * | 5/1980 | Borgstrom | H01R 13/53 218/156 |
| 4,354,721 | A | 10/1982 | Luzzi | |
| 4,360,967 | A | 11/1982 | Luzzi et al. | |
| 4,715,104 | A | 12/1987 | Schoenwetter et al. | |
| 4,722,694 | A * | 2/1988 | Makal | H01R 13/53 439/181 |
| 4,776,089 | A | 10/1988 | Schoenwetter et al. | |
| 4,779,341 | A | 10/1988 | Roscizewski | |
| 4,857,021 | A * | 8/1989 | Boliver | H01R 13/53 439/801 |
| 5,114,357 | A * | 5/1992 | Luzzi | H01R 13/53 439/183 |
| 5,116,265 | A * | 5/1992 | Brown | H01R 13/53 411/302 |
| 5,421,750 | A * | 6/1995 | Crotty | H01R 13/53 439/801 |
| 6,042,407 | A * | 3/2000 | Scull | H01R 13/53 439/181 |
| 6,364,216 | B1 | 4/2002 | Martin | |
| 6,520,795 | B1 * | 2/2003 | Jazowski | H01R 25/003 439/475 |
| 7,381,103 | B2 | 6/2008 | Luzzi | |
| 7,503,785 | B2 * | 3/2009 | Stepniak | H01R 13/53 439/187 |
| 7,517,260 | B2 | 4/2009 | Luzzi | |
| 7,556,540 | B2 | 7/2009 | Siebens et al. | |

(Continued)

*Primary Examiner* — Gary Paumen

(74) *Attorney, Agent, or Firm* — Hoffmann & Baron, LLP

(57) ABSTRACT

An elbow with an internal assembly system that includes an elbow body, a cable connection, a first tap, a second tap, a mid-section, a rotating nut and an axial bore. The cable connection adapted to receive a cable having a cable connector, the first tap adapted to receive a first interface device with a threaded stud and the second tap adapted to receive a second interface device. The rotating nut is located in the mid-section and has a threaded bore in communication with the first tap and an opposing closed end with a keyed opening for receiving a tool. The tool is inserted through the axial bore and into the keyed opening to rotate the rotating nut to secure the threaded stud in the rotating nut and secure the cable connector in place.

20 Claims, 5 Drawing Sheets

FIG. 5

(56) References Cited

U.S. PATENT DOCUMENTS

| | | | | |
|---|---|---|---|---|
| 7,588,469 | B2 * | 9/2009 | Luzzi | H01R 13/53 439/181 |
| 7,690,955 | B2 | 4/2010 | Siebens et al. | |
| 7,870,668 | B2 | 1/2011 | Hughes et al. | |
| 7,972,155 | B1 | 7/2011 | Siebens | |
| 8,018,707 | B2 | 9/2011 | Yaworski et al. | |
| 8,328,569 | B2 | 12/2012 | Roscizewski et al. | |
| 8,641,434 | B2 | 2/2014 | Siebens et al. | |
| 2006/0286837 | A1 * | 12/2006 | Luzzi | H01R 13/53 439/181 |
| 2007/0141882 | A1 | 6/2007 | Stepniak | |
| 2008/0227342 | A1 | 9/2008 | Luzzi | |
| 2009/0017667 | A1 | 1/2009 | Siebens et al. | |
| 2009/0233496 | A1 | 9/2009 | Siebens et al. | |
| 2010/0149715 | A1 | 6/2010 | Yaworski et al. | |
| 2011/0256746 | A1 * | 10/2011 | Borgstrom | H01R 13/53 439/181 |
| 2011/0287652 | A1 | 11/2011 | Roscizewski et al. | |
| 2012/0018217 | A1 | 1/2012 | Siebens et al. | |
| 2014/0024241 | A1 | 1/2014 | Siebens | |
| 2014/0057467 | A1 | 2/2014 | Siebens | |

* cited by examiner

ELBOW WITH INTERNAL ASSEMBLY SYSTEM

This application claims priority from provisional application Ser. No. 62/017,531, filed on Jun. 26, 2014, which is incorporated herein in its entirety.

FIELD OF THE INVENTION

The present invention is an elbow with an internal assembly system for connecting the elbow to a bushing. In particular, the present invention relates to a reducing elbow wherein the internal assembly system includes a rotating nut for internal connection of an interface device.

BACKGROUND OF INVENTION

When a reducing tap is connected to a prior art 600 amp high voltage elbow, a spanner wrench is used to rotate the reducing tap onto a threaded stud inside the elbow. The reducing tap is coated in hardened epoxy that can crack or break when the wrench is attached to the reducing tap and force is applied. Typically, a torque wrench is coupled to a short spanner wrench. Due to the added distance from the center of the reducing tap to the square drive on the spanner wrench, additional stress is applied to the epoxy covering the reducing tap. In the past, one way to avoid damage to the epoxy coating was to reduce the tightening torque (see FIG. 1).

FIG. 1 shows a prior art 600 amp reducing elbow assembly that includes a 600 amp elbow A, a 600 amp bushing B and a 600 to 200 (600/200) amp reducing bushing C. The 600 amp bushing B has a threaded stud D connected to the end that connects to the elbow A. The 600 amp bushing B is inserted into one tap E of the elbow A and the 600/200 amp reducing bushing C is inserted into the opposing tap F of the elbow A. In order to secure the two bushings in the elbow A, the 600/200 amp reducing bushing C is rotated onto the threaded stud D using a spanner wrench G that fits around the outside of the 600/200 amp reducing bushing C. A torque wrench H can then be attached to the spanner wrench G to rotate the 600/200 amp reducing bushing C to the required torque.

The drawbacks to the elbow assembly shown in FIG. 1 include the overall dimensions of the assembly, the potential damage to the epoxy-coated reducing bushing that may be caused by the spanner wrench and the difficulty of applying the exact torque required to ensure a proper connection. Accordingly, there is a need for a 600 amp elbow with a 200/600 amp reducing tap that does not require the tap to be rotated when connected to the elbow.

SUMMARY OF THE INVENTION

In accordance with the present invention, an elbow with an internal assembly system is provided. The elbow with an internal assembly system comprises, consists of or consists essentially of an elbow body, a cable connection, a first tap, a second tap, a rotating nut and an axial bore. The elbow body is preferably made of an elastomer material and has a mid-section and a longitudinal axis extending between the opposing first and second taps. The cable connection is located at the mid-section and it is adapted to receive a cable having a cable connector. Preferably, the cable connector is a ring or spade connector. The first tap has a passage adapted to receive a distal end of a first interface device and, preferably, the distal end has a threaded stud. The second tap has a female contact adapted to receive a second interface device. Preferably, the first interface device is a 600 amp deadbreak interface and the second interface device 200 amp deadbreak interface. The cable connector has an opening that is aligned with the longitudinal axis, and wherein the threaded stud of the first interface device is adapted to pass through the cable connector opening into the threaded bore of the rotating nut.

The rotating nut is located in the mid-section of the elbow and has a threaded bore in communication with the passage in the first tap and an opposing closed end with a keyed opening configured for receiving a tool. The rotating nut is captured or retained in the elbow by a housing, preferably, an electrically conductive metal housing that is preferably made of copper. The axial bore extends from the keyed opening of the rotating nut to the female contact of the second tap. The tool is inserted through the axial bore and into the keyed opening to rotate the rotating nut in order to secure the threaded stud in the rotating nut. Preferably, the keyed opening is a hex broach configured to receive a hex tool. However, the use of similar tools and keyed openings in the rotating nut are within the scope of the invention. Tightening the threaded stud in the rotating nut also secures the cable connector in the elbow body. The tool is then withdrawn from the axial bore and the second interface device is connected to the female contact of the second tap. The electrically conductive metal housing of the rotating nut is in electrical contact with the cable connector after the rotating nut is secured to the threaded stud.

BRIEF DESCRIPTION OF THE FIGURES

The preferred embodiments of the elbow with internal assembly system of the present invention, as well as other objects, features and advantages of this invention, will be apparent from the accompanying drawings wherein.

DETAILED DESCRIPTION OF THE INVENTION

Figure 1:
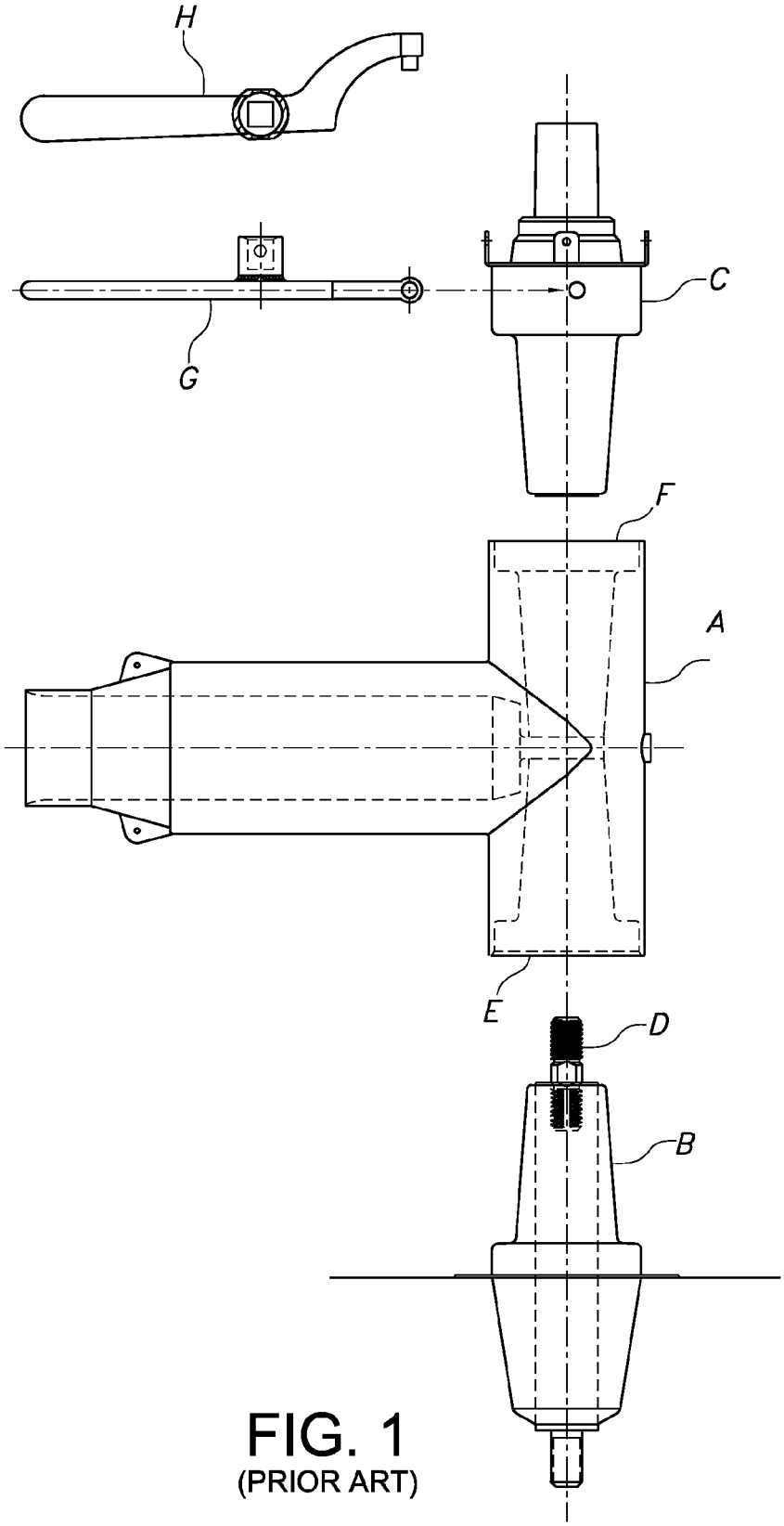
FIG. 1 (PRIOR ART)
FIG. 1 is an exploded side view of a prior art elbow connected to a reducing bushing and a bushing using a wrench to rotate the reducing bushing.

The present invention is an elbow with an internal assembly system that solves the problem of damaging the epoxy coating on a reducing tap by providing a 600 amp high voltage elbow with an integral reducing tap and an internal rotating nut. The rotating nut is provided so that a hex wrench can be used to attach the assembly to a 600 amp bushing inserted into the tap of the elbow opposite the reducing tap. The connection of the 600 amp bushing to the elbow is done inside the elbow through the reducing tap so that reducing tap does not have to be rotated.

The elbow with internal assembly system provides several benefits, including: a one piece construction that eliminates the need for a reducing bushing. The one piece construction also reduces the overall dimensions of the elbow so that it can be installed in locations where space is limited. The internal nut for connecting the elbow to a bushing is rotated (also referred to as torqued) using a hex assembly tool that passes through an axial bore in the contact of the reducing tap to engage the hex bit socket in the rotating nut. The hex assembly tool is directly connected to the hex bit socket so that a torque wrench can be used to directly tighten the hex bit socket. In contrast, to assemble the elbows that are currently being used, a spanner wrench engages the reducing bushing and a torque wrench is then attached to the spanner wrench. This assembly makes it difficult to accurately calculate the torque that is being applied.

The elbow body has a cable connection on one side and two opposing taps that are perpendicular to the cable connection. The cable connection receives a cable having a cable connector with an opening. The first tap has a passage that receives the distal end of a first interface device and the second tap has a female contact with an axial bore that receives a second interface device. The elbow has a mid-section (also referred to as an intermediate section) between the first and second taps and a longitudinal axis extending between the first and second taps. The passage in the first tap and the axial bore in the second tap have the same axes as the longitudinal axis of the elbow. The passage in the first tap and the axial bore in the second tap are preferably tapered so that, as they extend from the tap openings into the midsection of the elbow, the cross-sectional dimensions decrease. The first and second taps can be the same size (i.e., the amperage rating for the connector) or they can be different sizes. When the elbow has taps with different sizes, the elbow acts as a reducing elbow. For example, the first interface device can be a 600 amp deadbreak interface and the second interface device can be 200 amp deadbreak interface.

A rotating nut is captured in an electrically conductive metal housing located in the mid-section of the elbow. Preferably, the electrically conductive metal housing and the rotating nut are made of copper. The first end of the rotating nut, which is accessible through the passage in the first tap, has a threaded bore and the second end, which is accessible through the axial bore in the second tap, is closed and has a keyed opening, preferably a hex broach. A tool can be inserted through the axial bore and into the keyed opening in the rotating nut. Once inserted in the keyed opening, the tool can be rotated to rotate and tighten the rotating nut onto the first interface device.

In a preferred embodiment, a threaded stud is connected to, or formed as part of, the distal end of the first interface device. When the first interface device is installed in the first tap, the threaded stud passes through the opening in the cable connector and then into the rotating nut. A tool, for example a hex wrench, is inserted into the second tap and through the axial bore to the keyed opening in the rotating nut. When a hex wrench is used, the keyed opening is a fitting formed in the rotating nut and designed to receive a hex tool. After the tool engages the keyed opening, the tool is rotated to tighten the rotating nut onto the threaded stud. A torque wrench can be used with the tool to apply a predetermined torque. Once the rotating nut is tightened, the first interface device and the cable connector are secured in the elbow. The second interface device is then inserted into the second tap of the elbow to complete the installation.

Preferably, a standard tap and a reducing tap are integrally formed as part of the elbow, i.e., as one piece, which eliminates the need for a reducing bushing. However, the elbow does not have to be used as a reducer and the first and second taps can be the same size or amperage rating. Inside the elbow is the rotating nut with a broached or keyed opening on the top that is accessible through an axial bore that passes through the upper contact of the reducing tap. As used herein, the term "broach", "broached hole" or "keyed opening" refers to an opening or recessed area with a specific configuration in the surface of the nut that is designed to receive a tool with a corresponding configuration. The tool is inserted through the axial bore and into the opening and used to rotate the nut. In one embodiment, a hex assembly tool, preferably a hex wrench, is inserted through the axial bore and into a keyed opening in the rotating nut that is configured to accept the hex wrench. The hex wrench is used to torque the rotating nut to secure the standard bushing in the elbow. A torque wrench can be attached to the hex assembly tool in order to provide the correct torque to the internal assembly system. The shape of the opening (star, slotted or multi-sided) in the top of the nut and the corresponding shape of the tool used to rotate the nut are not intended to limit the invention and any structure formed on the top of the nut that can be used to engage a tool for rotating the nut is contemplated by the present invention.

The cable connection is adapted to receive a cable so that the cable connector opening is aligned with the longitudinal axis. The cable connector can be a ring or spade connector. The threaded stud of the first interface device is adapted to be inserted into the threaded bore of the rotating nut through the cable connector opening. A hex assembly tool is inserted through the axial bore and into the hex broach to rotate the rotating nut to secure the threaded stud in the rotating nut and to secure the cable connector in place. The hex assembly tool is then withdrawn from the axial bore and the second interface device is connected to the female contact of the second tap. The electrically conductive metal housing of the rotating nut is in electrical contact with the cable connector after the elbow is assembled.

Figure 2:
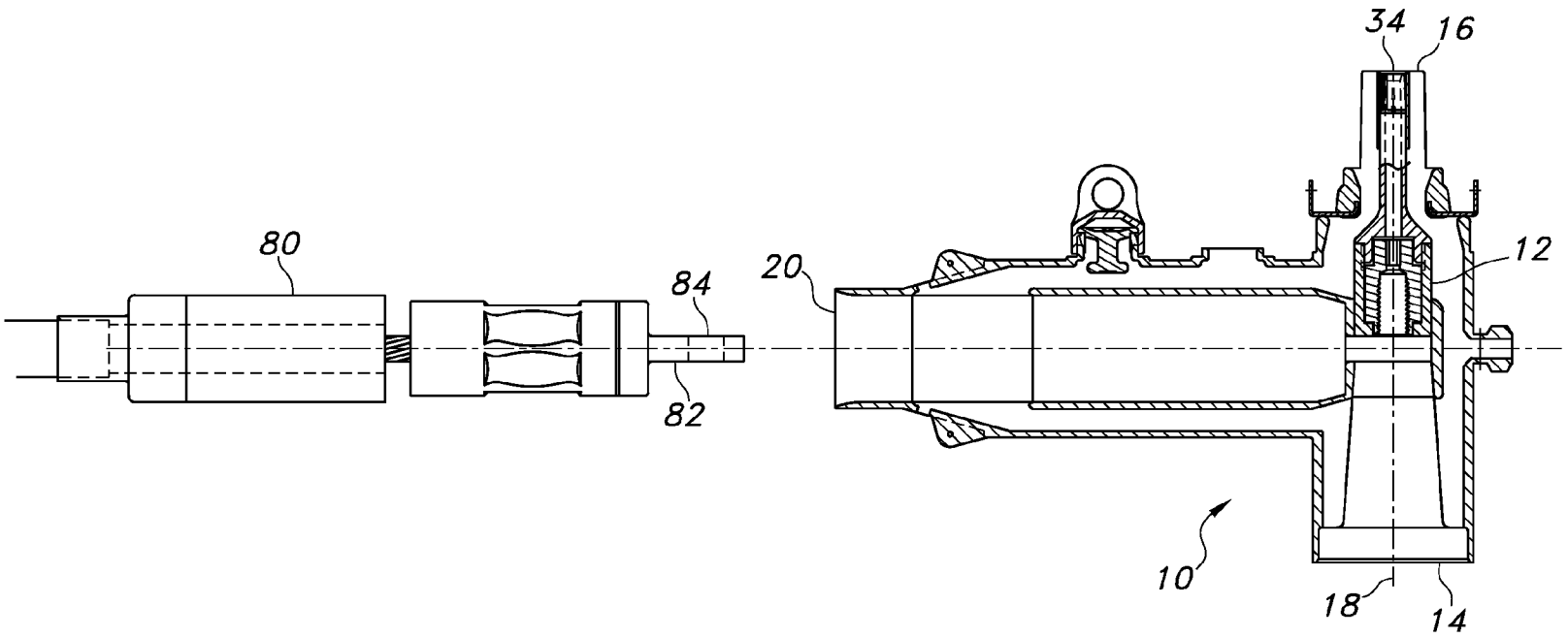
FIG. 2 is a sectional side view of a first embodiment of the elbow with an internal assembly system of the present invention showing a cable prior to insertion in the elbow.
Figures 3, 5:
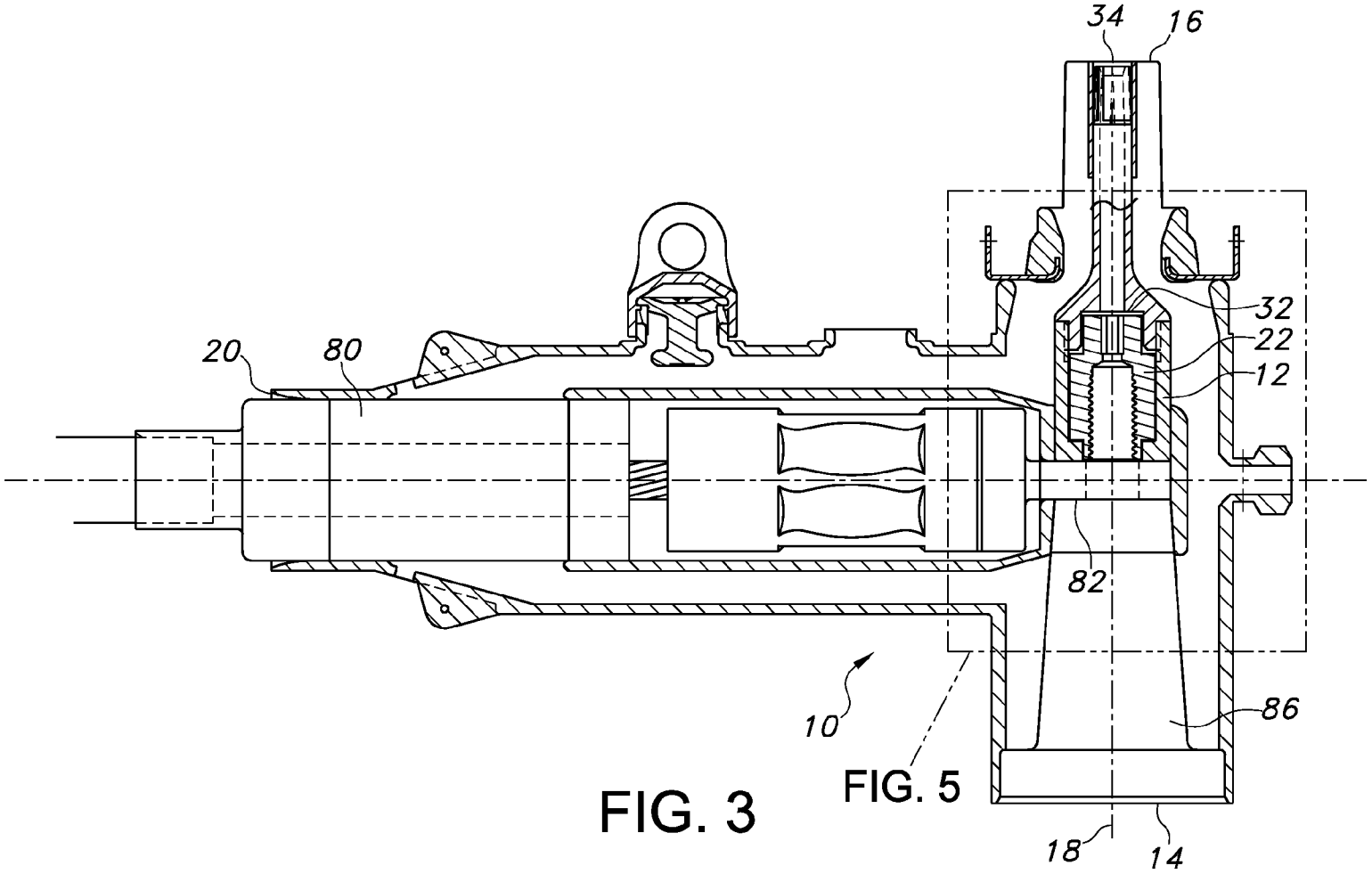
FIG. 3 is a sectional side view of the elbow with the internal assembly system shown in FIG. 2 with the cable inserted in the elbow and a detail of the internal assembly system shown in FIG. 5.
FIG. 5 is a detail of the internal assembly system shown in FIG. 3.
Figure 4:
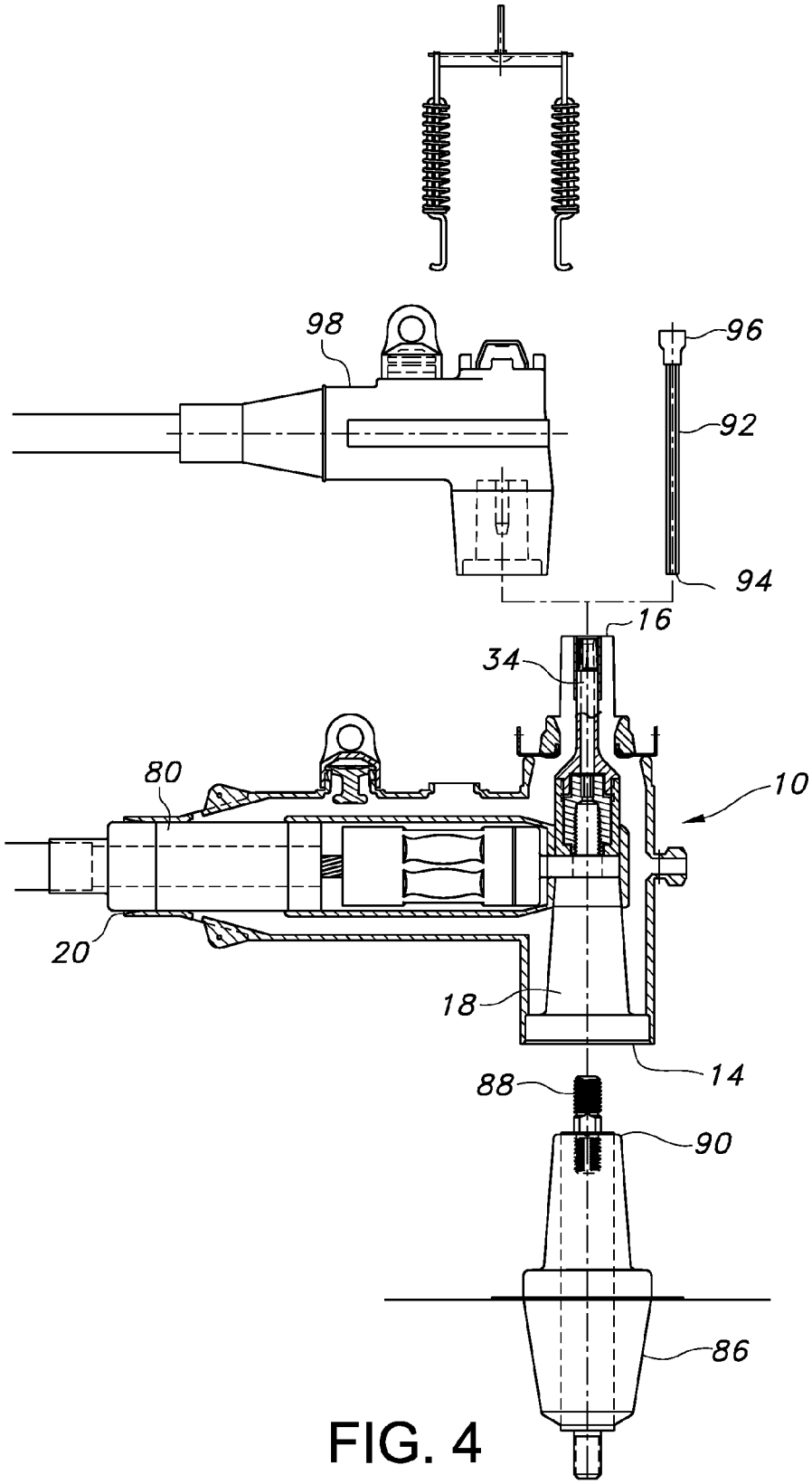
FIG. 4 is a sectional side view of the elbow with the internal assembly system shown in FIG. 3 with the cable inserted in the elbow.
Figure 5:
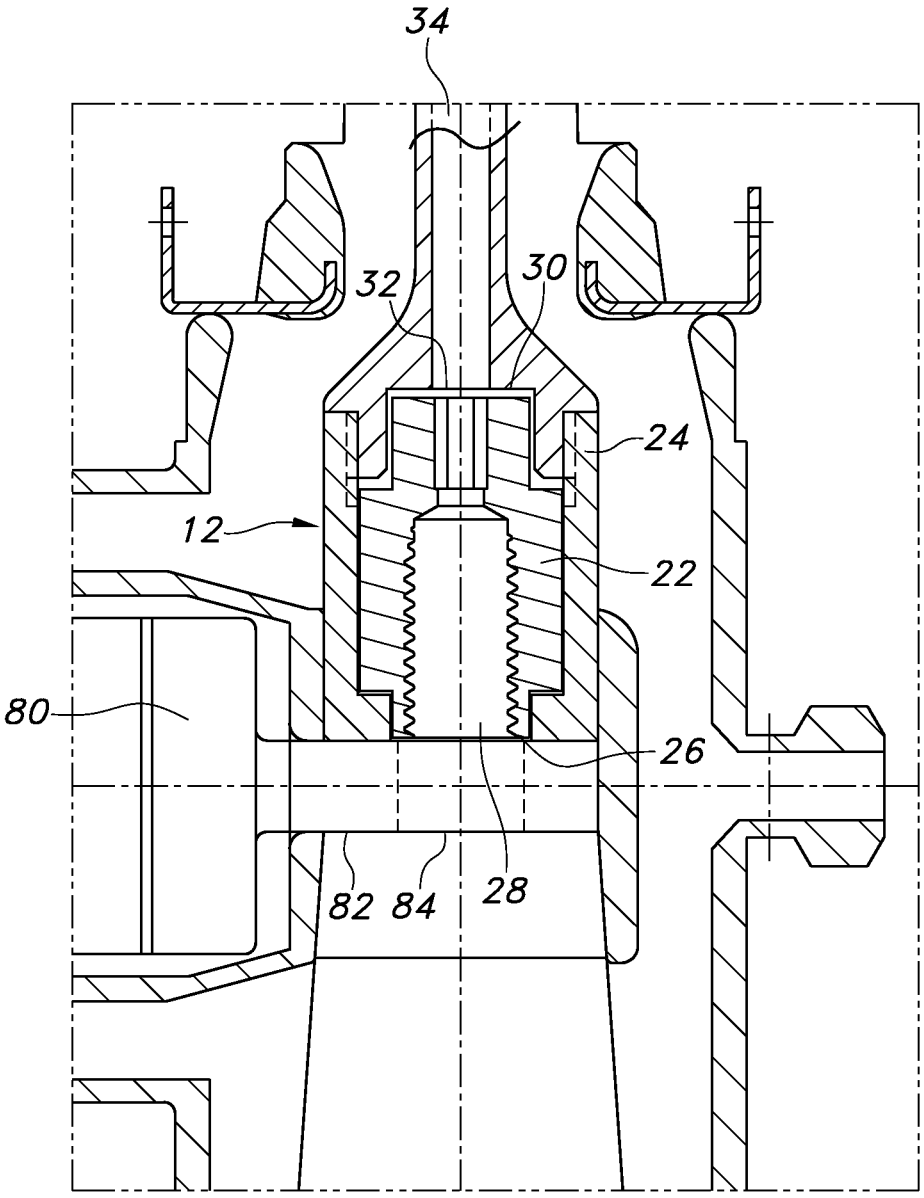

Referring now to the drawings, FIGS. 2-4 show a 600/200 amp elbow or elbow body 10 with an internal assembly system 12. The elbow 10 includes a first tap 14 for a 600 amp interface opposite a second tap 16 for a 200 amp interface along the longitudinal axis 18 of the elbow 10. The 600 amp interface and the 200 amp interface are electrically connected by the internal assembly system 12. A cable connector 20 for receiving a cable 80 is located perpendicular to the longitudinal axis 18. The cable 80 has a connector 82 at its end and, when the cable 80 is inserted into the cable connector 20 of the elbow 10, the opening 84 in the connector 82 is aligned with the longitudinal axis 18.

The internal assembly 12 includes a rotating nut 22 that is captured by a copper housing 24. As used herein, the term "captured" means that the rotating nut 22 is confined inside the housing 24 so that its movement along the longitudinal axis is limited, but its ability to rotate inside the housing 24 is not restricted. The rotating nut 22 has a first end 26 with a threaded bore 28 that connects to a threaded stud 88 on a 600 amp interface 86, such as a bushing, and an opposing second end 30 with a hex broach 32 (also referred to herein as a hex bit socket). The hex broach 32 receives a hex assembly tool 92 that is used to rotate the rotating nut 22 and connect the 600 amp bushing 86.

After the cable 80 is inserted into the elbow 10 and the opening 84 in the connector 82 is aligned with the longitudinal axis 18 of the elbow 10, a 600 amp interface device 86 with a threaded stud 88 on its distal end 90 is inserted into the 600 amp tap 14 so that the threaded stud 88 passes through the opening 84 in the connector 82 and engages the rotating nut 22. The hex assembly tool 92 is then passed through the axial bore 34 in the 200 amp interface end 16 of the elbow 10 and the first end 94 of the hex assembly tool 92 engages the hex broach 32 (i.e., the opening in the top of the rotating nut 22 that receives the hex tool 92). The second end 96 of the hex assembly tool 92 is connected to a wrench (not shown), preferably a torque wrench. The hex assembly tool 92 rotates the rotating nut 22 to the required torque to connect the 600 amp bushing 86 to the elbow 10 and secure the connector 82 in the elbow 10. The hex assembly tool 92 is then removed and a 200 amp interface device 98, such as a 200 amp deadbreak elbow tap, can be attached to the second tap 16 of the elbow 10.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. An elbow with an internal assembly system comprising:

an elbow body;

a cable connection adapted to receive a cable having a cable connector;

a first tap having a passage adapted to receive a distal end of a first interface device, the distal end having a threaded stud;

a second tap having a female contact adapted to receive a second interface device, a mid-section therebetween and a longitudinal axis extending between the first and second taps;

a rotating nut located in the mid-section of the elbow, the rotating nut having a threaded bore in communication with the passage in the first tap and an opposing closed end with a keyed opening configured for receiving a tool; and an axial bore extending from the keyed opening of the rotating nut to the female contact of the second tap, wherein the tool is inserted through the axial bore and into the keyed opening to rotate the rotating nut to secure the threaded stud in the rotating nut and secure the cable connector in the elbow body, and wherein the tool is withdrawn from the axial bore and the second interface device is connected to the female contact of the second tap.

2. The elbow according to claim 1, wherein the first interface device is a 600 amp deadbreak interface and the second interface device 200 amp deadbreak interface.

3. The elbow according to claim 1, wherein the cable connector is a ring or spade connector.

4. The elbow according to claim 1, wherein an electrically conductive metal housing of the rotating nut is made of copper.

5. The elbow according to claim 1, wherein an electrically conductive metal housing of the rotating nut is in electrical contact with the cable connector after the rotating nut is secured to the threaded stud.

6. The elbow according to claim 1, wherein the keyed opening is a hex broach configured to receive a hex tool.

7. The elbow according to claim 1, wherein the rotating nut is captured in an electrically conductive metal housing.

8. The elbow according to claim 1, wherein the cable connector has an opening that is aligned with the longitudinal axis, and wherein the threaded stud of the first interface device is adapted to pass through the cable connector opening into the threaded bore of the rotating nut.

9. The elbow according to claim 1, wherein the elbow is made of an elastomer material.

10. An elbow with an internal assembly system comprising:

an elbow body;

a cable connection adapted to receive a cable having a cable connector;

a first tap having a passage adapted to receive a distal end of a first interface device having a first amperage rating, the distal end having a threaded stud;

a second tap having a female contact adapted to receive a second interface device having a second amperage rating;

a mid-section therebetween and a longitudinal axis extending between the first and second taps, wherein the first amperage rating is greater than the second amperage rating;

a rotating nut located in the mid-section of the elbow and captured in an electrically conductive metal housing, the rotating nut having a threaded bore in communication with the passage in the first tap and an opposing closed end with a keyed opening configured for receiving a tool; and an axial bore extending from the keyed opening of the rotating nut to the female contact of the second tap;

wherein the tool is inserted through the axial bore and into the keyed opening to rotate the rotating nut to secure the threaded stud in the rotating nut and secure the cable connector in the elbow body, and wherein the tool is withdrawn from the axial bore and the second interface device is connected to the female contact of the second tap.

11. The elbow according to claim 10, wherein the first amperage rating is 600 amps and the second amperage rating is 200 amps.

12. The elbow according to claim 10, wherein the cable connector is a ring or spade connector.

13. The elbow according to claim 10, wherein the electrically conductive metal housing of the rotating nut is made of copper.

14. The elbow according to claim 10, wherein the electrically conductive metal housing of the rotating nut is in electrical contact with the cable connector after the rotating nut is secured to the threaded stud.

15. The elbow according to claim 10, wherein the keyed opening is a hex broach configured to receive a hex tool.

16. The elbow according to claim 10, wherein the cable connector has an opening that is aligned with the longitudinal axis, and wherein the threaded stud of the first interface device is adapted to pass through the cable connector opening into the threaded bore of the rotating nut.

17. An elbow with an internal assembly system comprising:

an elbow body;

a cable connection adapted to receive a cable having a cable connector with an opening;

a first tap having a passage adapted to receive a distal end of a first interface device having a first amperage rating, the distal end having a threaded stud;

a second tap having a female contact adapted to receive a second interface device having a second amperage rating, wherein the first amperage rating is greater than the second amperage rating;

a mid-section therebetween and a longitudinal axis extending between the first and second taps, wherein the cable connector opening is aligned with the longitudinal axis;

a rotating nut located in the mid-section of the elbow and captured in an electrically conductive metal housing, the rotating nut having a threaded bore in communication with the passage in the first tap and an opposing closed end with a keyed opening configured for receiving a tool, wherein the threaded stud of the first interface device is adapted to pass through the cable connector opening into the threaded bore of the rotating nut, and wherein the electrically conductive metal housing of the rotating nut is in electrical contact with the cable connector after the rotating nut is secured to the threaded stud; and an axial bore extending from the keyed opening of the rotating nut to the female contact of the second tap;

wherein the tool is inserted through the axial bore and into the keyed opening to rotate the rotating nut to secure the threaded stud in the rotating nut and secure the cable connector in the elbow body, and wherein the tool is withdrawn from the axial bore and the second interface device is connected to the female contact of the second tap.

18. The elbow according to claim 17, wherein the first amperage rating is 600 amps and the second amperage rating is 200 amps.

19. The elbow according to claim 17, wherein the cable connector is a ring or spade connector.

20. The elbow according to claim 17, wherein the keyed opening is a hex broach configured to receive a hex tool.

* * * * *